US006835012B1

(12) United States Patent
Neri

(10) Patent No.: US 6,835,012 B1
(45) Date of Patent: Dec. 28, 2004

(54) RIBBON CASSETTE

(75) Inventor: Joel D Neri, Youngstown, NY (US)

(73) Assignee: International Imaging Materials Inc., Amherst, NY (US)

( * ) Notice: Subject to any disclaimer, the term of this patent is extended or adjusted under 35 U.S.C. 154(b) by 16 days.

(21) Appl. No.: 10/234,284

(22) Filed: Sep. 4, 2002

(51) Int. Cl.[7] ..... B41J 33/16
(52) U.S. Cl. ..... 400/234; 400/208.1; 400/235
(58) Field of Search ..... 400/234, 235, 400/235.1, 208.1, 280.1

(56) References Cited

U.S. PATENT DOCUMENTS 4,272,202 A * 6/1981 Schroeder et al. ..... 400/208
4,428,695 A * 1/1984 Jamieson ..... 400/249
4,490,059 A * 12/1984 Daughters ..... 400/208
4,493,572 A 1/1985 Van Ocker et al.
4,502,801 A * 3/1985 Hefti et al. ..... 400/208
5,032,032 A * 7/1991 Chu et al. ..... 400/234
5,259,679 A * 11/1993 Hwang ..... 400/234
5,399,036 A * 3/1995 Yamaguchi ..... 400/236
5,529,410 A * 6/1996 Hunter et al. ..... 400/234
5,857,786 A * 1/1999 Randolph ..... 400/234
5,993,092 A * 11/1999 Palmer ..... 400/234
6,290,408 B1 9/2001 Yorozu
6,307,583 B1 * 10/2001 Randolph et al. ..... 347/217

* cited by examiner

*Primary Examiner*—Daniel J. Colilla
*Assistant Examiner*—Dave A. Ghatt
(74) *Attorney, Agent, or Firm*—Howard J. Greenwald; Peter J. Mikesell

(57) ABSTRACT

A ribbon cassette containing a supply core, a web located on the supply core, a storage core, a device for increasing the tension on the web as it passes from said supply core to said storage core to produce a tensioned web, a drive roller contiguous with the web, and a nip roller contiguous with the web. The said tensioned web is passed in a first rotary direction around a portion of the drive roller, and then it is passed in a second rotary direction around a portion of the nip roller, and then it is passed in a in rotary direction identical to the first rotary direction around a portion of the storage core. A nip is formed between the nip roller, the web, and the drive roller such that either the nip roller or the drive roller is compressed by at least about 0.001 percent.

2 Claims, 10 Drawing Sheets

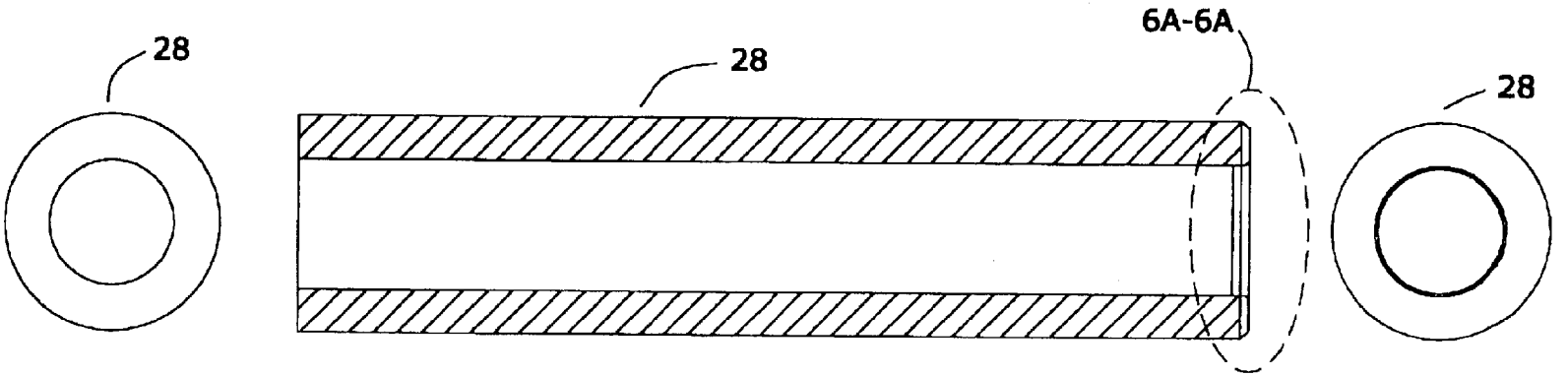
FIG.6D
FIG.6B
FIG.6C
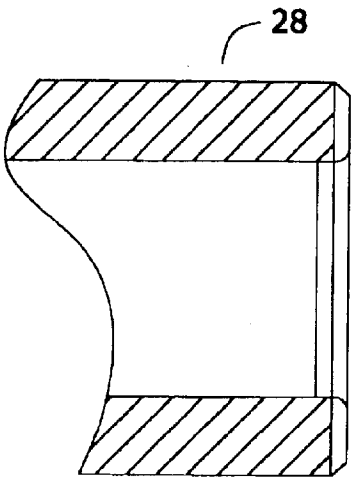
FIG.6A

RIBBON CASSETTE

FIELD OF THE INVENTION

A ribbon cassette capable of stabilizing the movement of an ink ribbon.

BACKGROUND OF THE INVENTION

U.S. Pat. No. 6,290,408 discloses that, with conventional ribbon cassettes, it is difficult to stabilize the ink ribbons during use as printing conditions vary. At column 2 of this patent, and with regard to a conventional ribbon cassette used in thermal printing, it is disclosed that: "Since the tensile load is applied to the ink ribbon 3 by the agency of the tension shaft of the thermal transfer printer, the tensile load is kept constant for all types of ink ribbons regardless of type. Therefore, all types of ink ribbons are not necessarily able to move steadily. Different types of ink ribbons behave differently when used for printing on the thermal transfer printer. Therefore, printing conditions, such as pressure for pressing the thermal print head against the platen, mode of driving the heating elements of the thermal print head and printing speed are controlled to print images properly. However, it is impossible to stabilize the movement of all types of ink ribbons only through the control of the printing conditions for the thermal transfer printer and, consequently, images are printed in a poor print quality."

The solution to this problem that is disclosed and claimed in U.S. Pat. No. 6,290,408 is: "A ribbon cassette comprising: a take-up reel and a feed reel supported for rotation in a housing, and an ink ribbon wound on the take-up reel and the feed reel; a print head receiving part formed in a section of a passage for the ink ribbon between the take-up reel and the feed reel to receive a thermal print head therein when the ribbon cassette is set in place on a thermal transfer printer; a take-up pinch roller and a feed pinch roller supported for rotation at a position between the print head receiving part and the take-up reel and at a position between the print head receiving part and the feed reel, respectively; and a friction mechanism for exerting a frictional force to the feed pinch roller to apply a tensile load to the ink ribbon, wherein the friction mechanism comprises an elastic friction member capable of exerting a frictional force on a core barrel included in the feed pinch roller by clasping the core barrel."

The system described in U.S. Pat. No. 6,290,408 does not allow one to readily vary the tension on the ink ribbon for different conditions. Furthermore, such prior art system does not provide good tension control for used ribbon taken up on the take up spool, which often tends to swell and thus precludes efficient gathering of all of the used ribbon. It is an object of this invention to provide an improved system which overcomes the problems presented by the system of such United States patent.

SUMMARY OF THE INVENTION

In accordance with this invention, there is provided a ribbon cassette comprising a supply core, a web disposed on said supply core, a storage core, means for passing said web from said supply core to said storage core, means for increasing the tension on said web as it passes from said supply core to said storage core to produce a tensioned web, a drive roller contiguous with said web, and a nip roller contiguous with said web, wherein said tensioned web is passed in a first rotary direction around a portion of said drive roller, wherein said tensioned web is passed in a second rotary direction opposite to said first rotary direction around a portion of said nip roller, wherein said tensioned web is passed in a in rotary direction identical to said first rotary direction around a portion of said storage core, and wherein said ribbon cassette is comprised of means for compressing said drive roller or said nip roller by at least about 0.001 percent.

BRIEF DESCRIPTION OF THE DRAWINGS

The invention will be described by reference to the following drawings, in which like numerals refer to like elements, and in which:

FIG. 6A is a partial sectional view of the roller used in the ribbon cassette of FIG. 1;

FIGS. 6B, 6C, and 6D are a sectional view, a front view, and a back view of the roller depicted in FIG. 6A;

DESCRIPTION OF THE PREFERRED EMBODIMENTS

Figure 1:
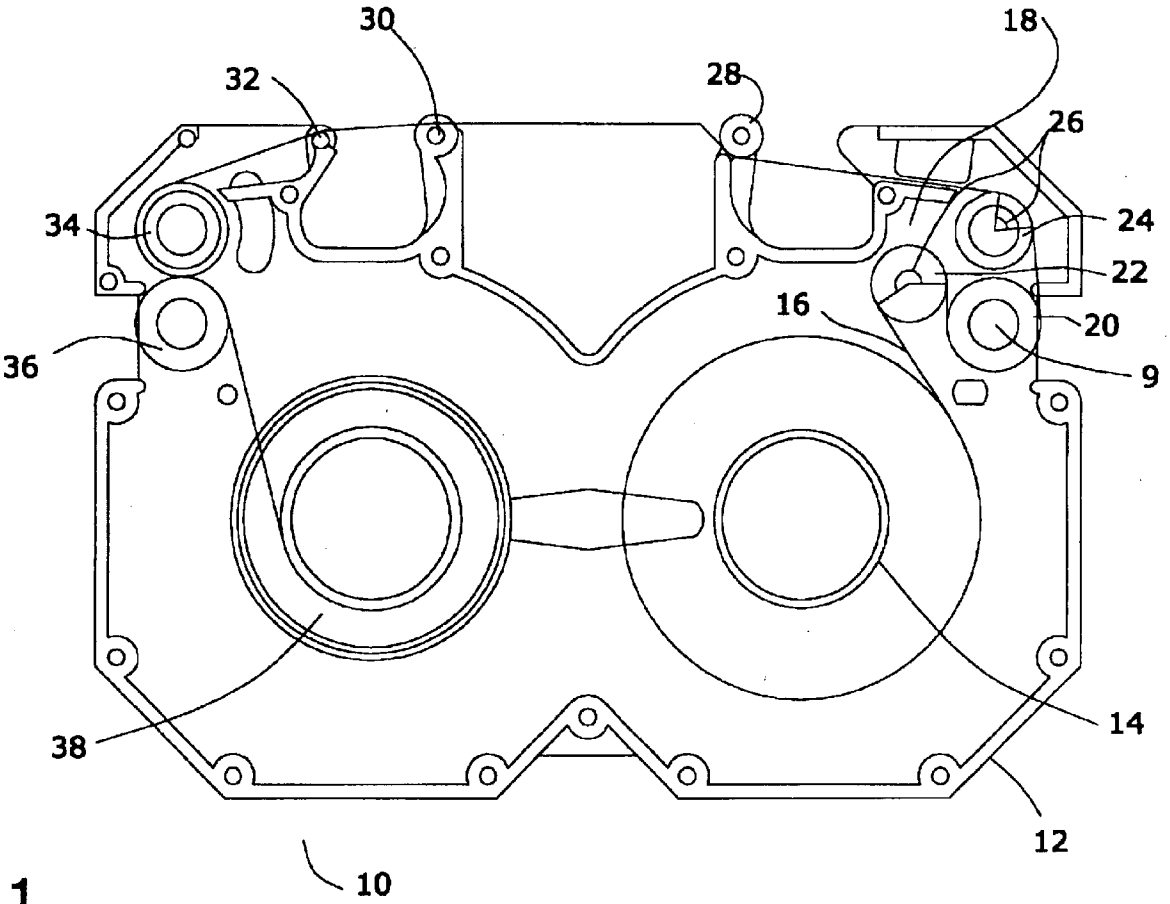
FIG. 1 is a schematic view of one preferred embodiment of the ribbon cassette of this invention.

FIG. 1 is a schematic illustration of one preferred ribbon cassette 10. In the embodiment depicted in FIG. 1, and for ease of description of the components of the ribbon cassette 10, the top casing (not shown in FIG. 1) has been removed from the cassette 10 depicted, showing the components of the cassette 10 disposed within bottom casing 12.

Referring to FIG. 1, it will be seen that, disposed within bottom casing 12 is supply core 14 from which ribbon 16 is unwound. The ribbon 16 can be wound around a variable tensioning assembly 18 in different configurations to impart differing degrees of tension to it.

In the embodiment depicted in the FIG. 1, the variable tensioning assembly 18 is comprised of a guide roller 20, a first stationary brake 22, and a second stationary brake 24.

Each of brake 22 and brake 24 is a stationary structure which preferably has a cylindrical cross sectional shape. This cylindrical cross-sectional shape maximizes the amount of contact between the ribbon 16 and the brake. The manner is which the ribbon 16 is wound about the brake 22 and/or the brake 24 will affect the contact angle(s) between the ribbon 16 and such brake(s) and, consequently, affect the degree to which the tension of the ribbon is increased. In the embodiment depicted in the FIG. 1, a contact angle 26 between ribbon 16 and brake 24 is illustrated.

As used in this specification, the term "contact angle" refers to the angular degree of wrap, i.e., the number of degrees that the ribbon contacts either brake 22 and/or brake 24. By way of illustration, if the ribbon contacted one-half of the periphery of each of brake 22 and brake 24, the contact angle would be 360 degrees.

In one embodiment, the angular degree of wrap in the cassette 10 is from about 8 to about 600 degrees. In one aspect of this embodiment, the angular degree of wrap is from about 180 to about 360 degrees.

In the embodiment depicted in FIG. 1, the brakes 22 and 24 have a circular cross-sectional shape. In other embodiments, not shown, such brakes 22 and 24 have noncircular arcuate shapes such as, e.g., an oval shape, an elliptical shape, an irregular arcuate shape, etc.

In one preferred embodiment, each of brake 22 and brake 24 is substantially parallel to the ribbon 16 to insure the maximum amount of contact between the ribbon 16 and the brakes 22/24. Furthermore, in this embodiment, each of the ribbon 16 and the brakes 22/24 are preferably substantially perpendicular to the bottom casing 12.

It is preferred that each of brake 22 and brake 24 have a coefficient of friction of from about 0.1 to about 0.8. It is more preferred that such coefficient of friction be from about 0.2 to about 0.6.

Referring again to FIG. 1, it will be seen that the ribbon 16 can be wound around the guide roller 20 and the brake 22 and/or the brake 24 in different manners, each of which will impart a different angular degree of wrap and a different amount of tensioning to the ribbon 16.

Figure 7:
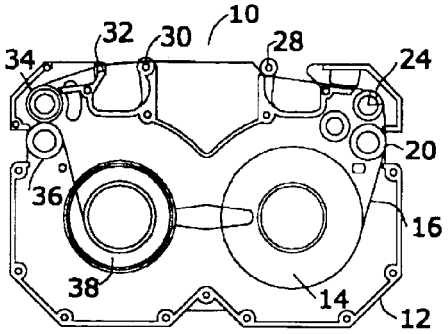
FIGS. 7–21 each depicts a schematic view of another preferred ribbon cassette of the invention.

In the manner depicted in FIG. 7, for ribbon cassette 10, the ribbon 16 is first contacted in a counterclockwise direction with guide roller 20 and thereafter contacted in a counterclockwise direction with brake 24. In the embodiment depicted, the angle of wrap of the ribbon 16 around brake 24 is 76 degrees (1.32 radians), and the coefficient of friction is 0.4. This tensioning method increases the tension of the ribbon 16 by about 170 percent.

As is known to those skilled in the art, the capstan equation may be used to calculate the ratio of the tension out to the tension in (To/Ti). This ratio is equal to $e^{ub}$, wherein e is the base of the natural logarithm and is equal to about 2.71828, u is the coefficient of friction of the brake material, and b is the wrap angle of the web around the brake (in radians). For a discussion of the capstan equation, reference may be had, e.g., to U.S. Pat. Nos. 4,610,060, 3,840,972, 3,778,878, 6,123,990, 5,912,078, 5,648,010, 5,523,243, 4,995,884, 4,124,156, 6,207,088, 6,120,695, 6,117,353, 6,077,468, 6,068,805, 4,624,793, 3,955,737, and the like. The entire disclosure of each of these United States patents is hereby incorporated by reference into this specification.

Figure 8:
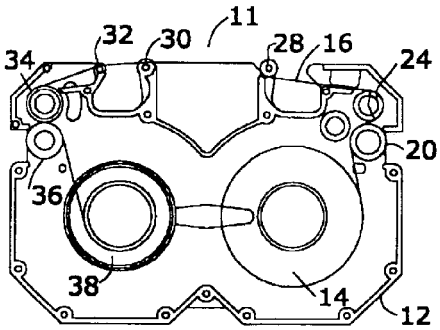

The configuration 11 depicted in FIG. 8 is similar to the configuration 10 depicted in FIG. 7, with the exception that the ribbon 16 is first contacted in a clockwise direction with guide roller 20. In configuration 11, the angle of wrap is 145 degrees (2.539 radians) and the coefficient of friction is 0.4. This configuration 11 will create a larger contact angle between the ribbon 16 and the brake 24 than is created in the configuration 10. Thus, this tensioning method 11 increases the tension of ribbon 16 by about 280 percent.

Figure 9:
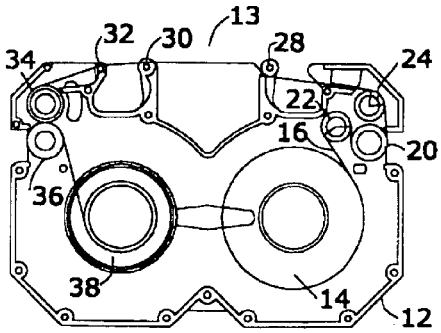
Figure 12:
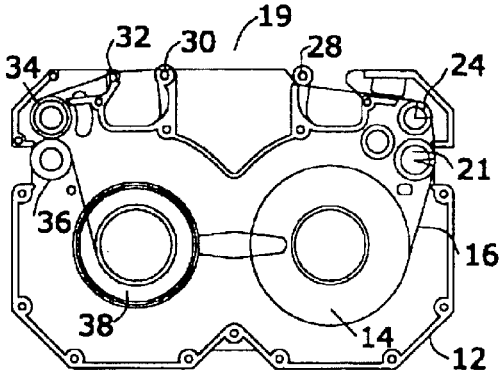
Figure 15:
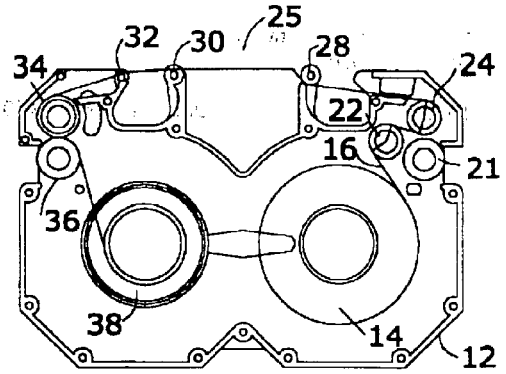
Figure 13:
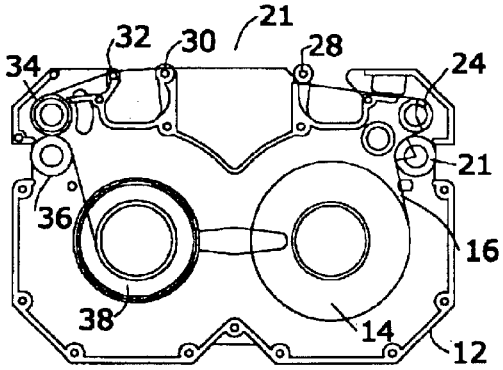
Figure 16:
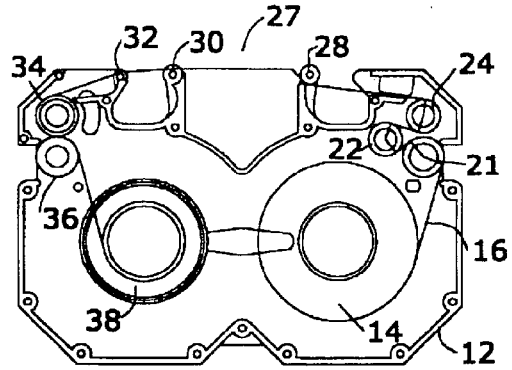
Figure 14:
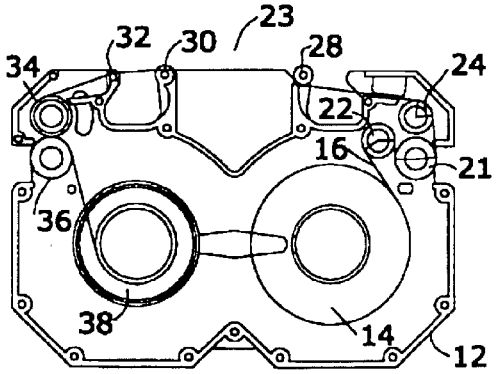
Figure 17:
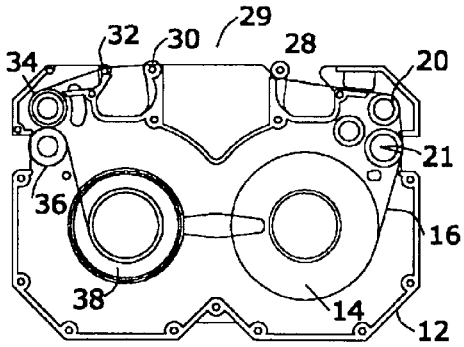
Figure 20:
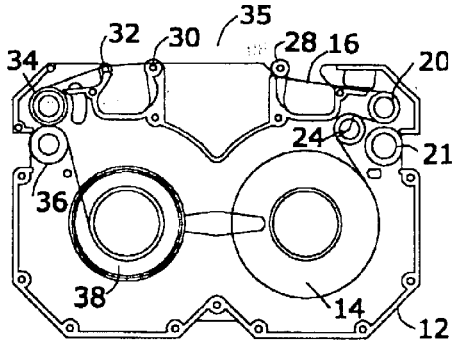
Figure 18:
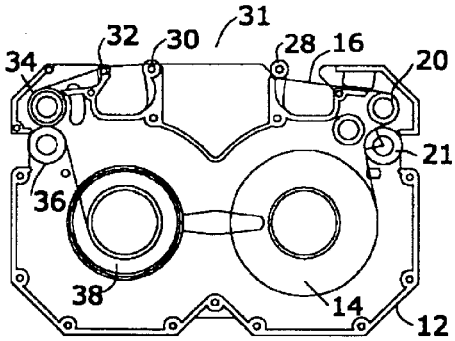
Figure 21:
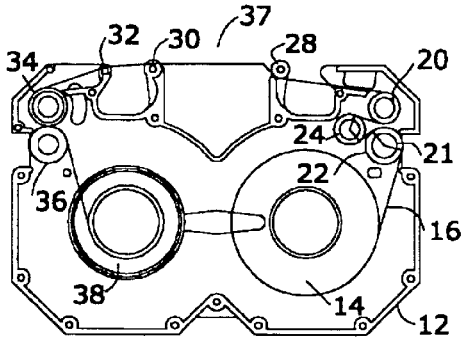
Figure 19:
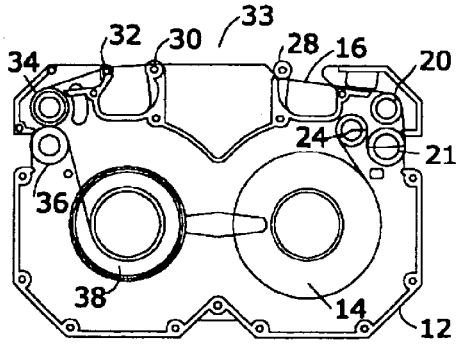

In the configuration 13 depicted in FIG. 9, the ribbon 16 is first contacted in a clockwise direction with brake 22, then it is contacted in a counterclockwise direction with guide roller 20, and then it is contacted in a counterclockwise direction with brake 24. In this configuration 13 the angle of wrap is 292 degrees (5.094 radians) and the coefficient of friction is 0.4. This configuration creates tension with both brake 22 and brake 24; and it increases the tension of ribbon 16 by about 770 percent.

Figure 10:
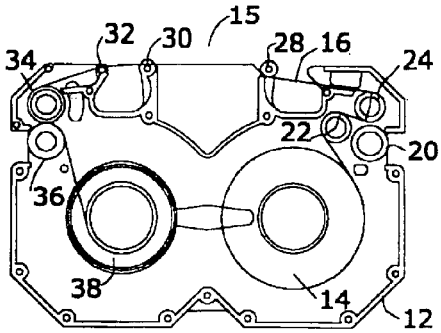

In the configuration 15 depicted in FIG. 10, the ribbon 16 is first contacted in a clockwise direction with brake 22 and then contacted in a counterclockwise direction with brake 24. In this configuration 15, the wrap angle is 350 degrees (6.113 radians) and the coefficient of friction is 0.4. In the configuration 15, there is a substantial amount of contact between ribbon 16 and both brake 22 and brake 24; and the use of this configuration increases the tension of ribbon 16 by about 1,150 percent.

Figure 11:
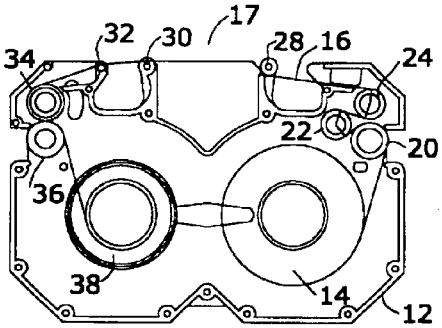

In the configuration 17 depicted in FIG. 11, the ribbon 16 is first contacted in a counterclockwise direction with guide roller 20, and then in a clockwise direction with brake 22, and then in a clockwise direction with brake 24. In this configuration 17, the angle of wrap is 434 degrees (7.571 radians) and the coefficient of friction is 0.4. The use of this configuration 17 increases the tensioning of ribbon 16 by about 2,070 percent.

In FIGS. 12 through 16, the configurations depicted are similar to the configurations depicted in FIGS. 7 through 11 with the exception that the guide roller 20 used in FIGS. 7 through 11 is replaced with a fixed arcuate surface (brake) 21 in the configurations depicted in FIGS. 12 through 16.

Referring to FIGS. 12 through 16, the wrap angles for configurations 19, 21, 23, 25, and 27 are 93 degrees (1.623 radians), 212 degrees (3.707 radians), 462 degrees (8.067 radians), 350 degrees (6.114 radians), and 558 degrees (9.734 radians), respectively; and the coefficients of friction for configurations 19, 21, 23, 25, and 27 are each 0.4. The ratio of Tout/Tin for configurations 19, 21, 23, 25, and 27, is 1.9, 4.4, 25.2, 11.5, and 49.1, respectively.

The configurations depicted in FIGS. 17, 18, 19, 20, and 21 are similar to the configurations depicted in FIGS. 12 through 16. Referring to FIGS. 17, 18, 19, 20, and 21, the wrap angles for configurations 29, 31, 33, 35, and 37 are 8 degrees (0.140 radians), 77 degrees (1.335 radians), 377 degrees (6.585 radians), 162 degrees (2.824 radians), and 360 degrees (6.287 radians), respectively; and the coefficients of friction for these configurations are 0.4. The ratio of Tout/Tin for configurations 29, 31, 33, 35, and 37 are 1.1, 1.7, 13.9, 3.1, and 12.4, respectively.

Referring again to FIG. 1, and in the preferred embodiment depicted therein, the brakes 22 and 24 preferably have a smooth exterior surface with no protuberances or irregularities that might damage the ribbon 16. In one aspect of this embodiment, the brakes 22 and 24 are made of polystyrene.

It is preferred that each of brakes 22 and 24 be substantially the same size and have a diameter of at least about 0.25 inches.

Referring again to FIG. 1, and in the preferred embodiment depicted therein, the guide roller 20 is preferably rotatably disposed on a stationary shaft 9.

Referring again to FIG. 1, and in the embodiment depicted, the ribbon 16 is passed under idler roller 28 and then over stationary shaft 30, and then over stationary shaft 32.

The ribbon 16 is then passed from stationary shaft 32 over drive roiler 34 (in a counterclockwise direction, over nip roller 36 (in a clockwise direction), and back onto the storage core 38. This arrangement is but one aspect of a general embodiment in which the ribbon 16 is passed over the drive roller 34 in a first rotary direction, and then passed over nip roller 36 in a second rotary direction that is opposite to the first rotary direction, and then passed over the storage core 38 in the first rotary direction.

Drive roller 34 may be any drive roller conventionally used in ink ribbon cassettes. Reference may be had, e.g., to U.S. Pat. Nos. 5,122,003, 4,655,623 (ink ribbon cassette), 5,762,430 (ribbon cassette), 5,472,286 (ink ribbon cassette), 4,676,681 (ink ribbon cassette), 4,732,500 (drive mechanism including floating pressure ring for ink ribbon cassette), 5,915,859 (pivotable ink ribbon cassette), 4,449,838 (ink ribbon cassette), 4,747,713 (ink ribbon cassette including geared teeth), 5,531,528 (cartridge for printers), 5,618,118, 4,948,283, 5,226,740, 5,156,474, 5,902,059, 5,320,437, 5,052,832, 5,020,928, 5,071,272 (ribbon cassette and protector), and the like; the disclosure of each of these United States patents is hereby incorporated by reference into this specification.

The nip roller 36 also may be similar to nip rollers known to those skilled in the art. Reference may be had, e.g., to U.S. Pat. Nos. 6,033,508, 5,875,034, 5,606,420, 5,493,409, 4,493,573 (see nip rollers 22 and 24), 5,713,504), and the like. The entire disclosure of each of these United States patents is hereby incorporated by reference into this specification.

In one embodiment, the drive roller 34 preferably is made from an elastomeric material and has a Shore hardness reading of from about 30 to about 60. In another embodiment, the nip roller 36 is made from an elastomeric material and has a Shore hardness reading of from about 30 to about 60. In yet another embodiment, both the drive roller 34 and the nip roller 36 are made from elastomeric material. In yet another embodiment, one of the drive roller 34 and the nip roller 36 is made from clastomeric material, and the other such roller is made from a non-elastomeric, relatively hard material with a Shore hardness of from 30 to 60.

In one embodiment, the drive roller 34 and the nip roller 36 are each contiguous with ribbon 16, and the nip roller 36 compresses the diameter of the drive roller by at least about 0.001 percent. In another embodiment, the drive roller 34 and the nip roller 36 are each contiguous with ribbon 16, and the drive roller 34 compresses the diameter of the nip roller 36 by at least about 0.001 percent. In both of these embodiments, a nip is formed between the driver roller 34, the ribbon 16, and the nip roller 36, i.e., one of the nip roller 36 and the drive roller 34 is compressed by at least about 0.001 percent by this assembly.

In one aspect of this embodiment, the diameter of the drive roller 34 or the nip roller 36 is compressed from about 0.001 to about 0.01 percent. In another aspect of this embodiment, the diameter of both the drive roller 34 and the nip roller 36 is compressed from about 0.001 to about 0.01 percent.

It is preferred that the nip roller be free rolling, i.e., that the nip roller have a low moment of inertia. Reference may be had, e.g., to element 29 depicted in U.S. Pat. No. 4,201,002, the entire disclosure of which is hereby incorporated by reference into this specification.

Figure 2:
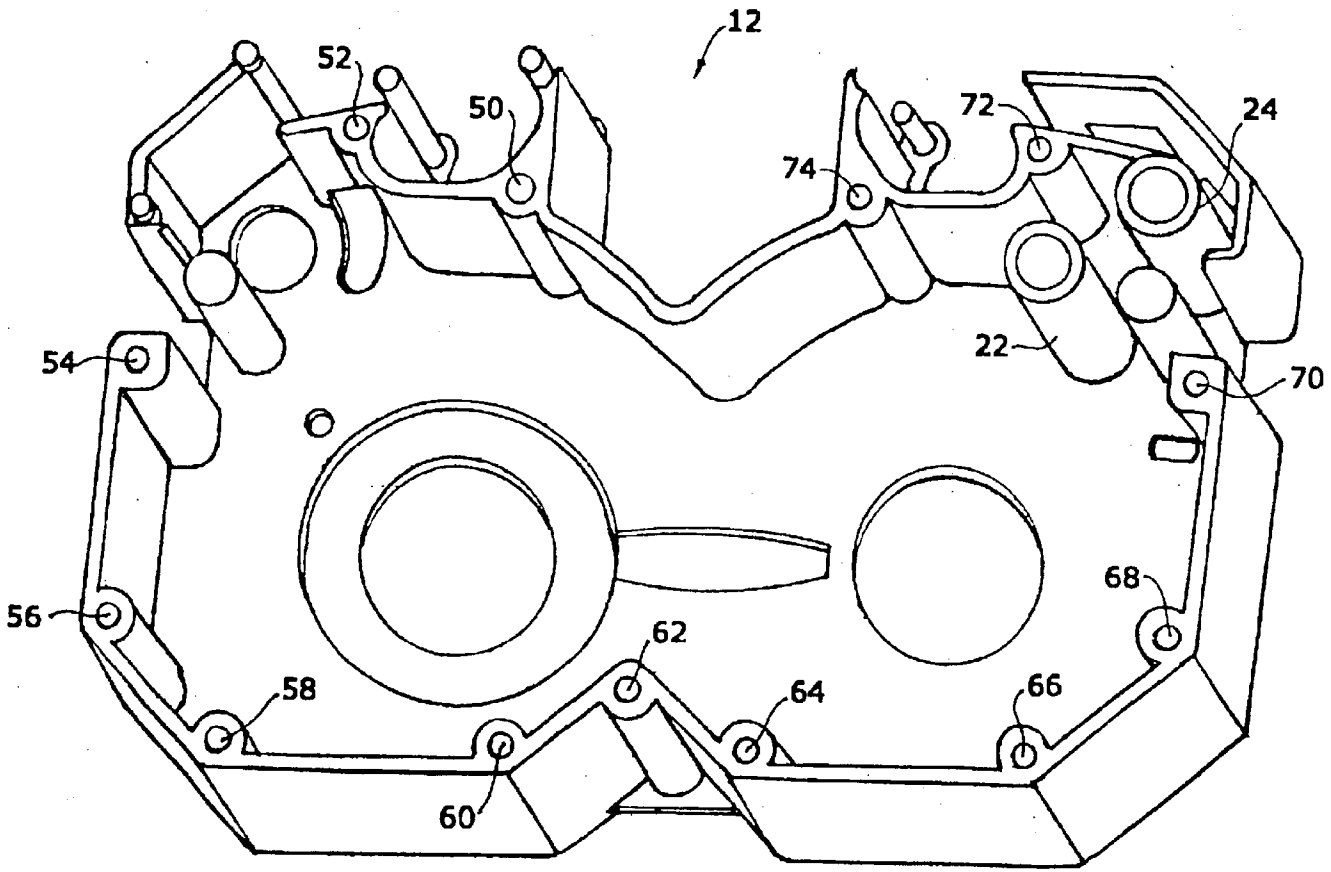
FIG. 2 is a top view of the cartridge base of the ribbon cassette of FIG. 1.

FIG. 2 is a top view of the casing 12 of ribbon cassette 10. Referring to FIG. 2, and in the preferred embodiment depicted therein, it will be seen that casing 12 is comprised of a multiplicity of orifices 50, 52, 54, 56, 58, 60, 62, 64, 66, 68, 70, 72, and 74. These orifices are adapted to receive a multiplicity of corresponding pins (pins 51, 53, 55, 57, 59, 61, 63, 65, 67, 69, 71, 73, and 75, respectively) that are preferably engageably disposed in such orifices and that extend upwardly from the base 77 of cartridge cover 79 (see FIG. 3).

Figure 3:
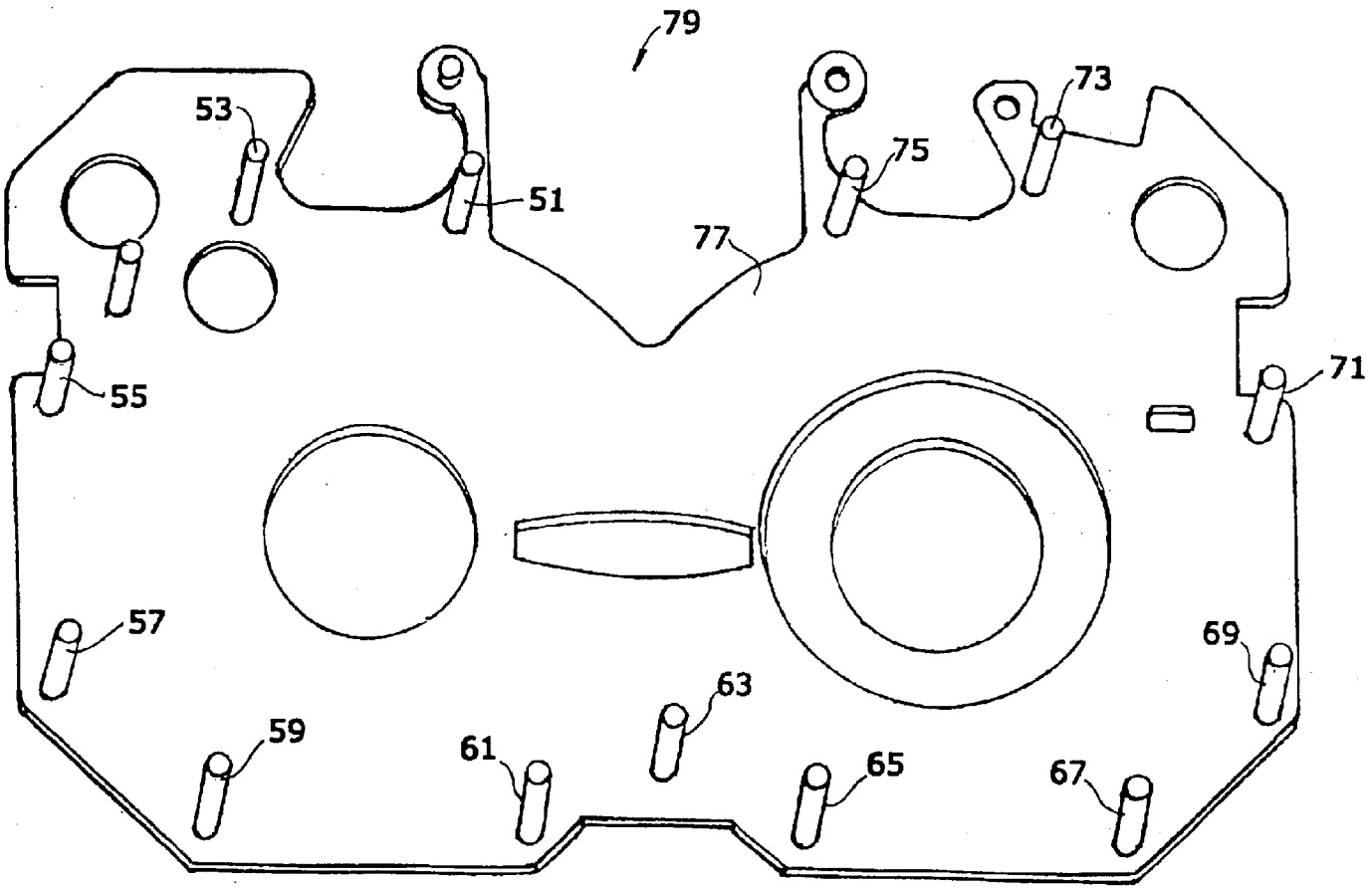
FIG. 3 is a top view of the cartridge cover of the ribbon cassette of FIG. 1.

Referring to FIG. 3, and in the embodiment depicted, it will be seen that there are 13 of such pins 51 et seq. In general, it is preferred to at least about 8 of such pins. In another embodiment, not shown, at least about 16 of such pins are used.

In one embodiment, the pins 51 et seq. are preferably friction fit in the, corresponding orifices 50 et seq. to removably connect the casing 12 to the cover 79; in another embodiment, the pins 51 et seq. are permanently disposed within the corresponding orifices so that, if one attempts to remove the cover from the casing, the pins will break. Each of these pins preferably has a length of at least about 0.125 inches. In one embodiment, each of these pins preferably has a length of at least about 0.25 inches.

Figure 4:
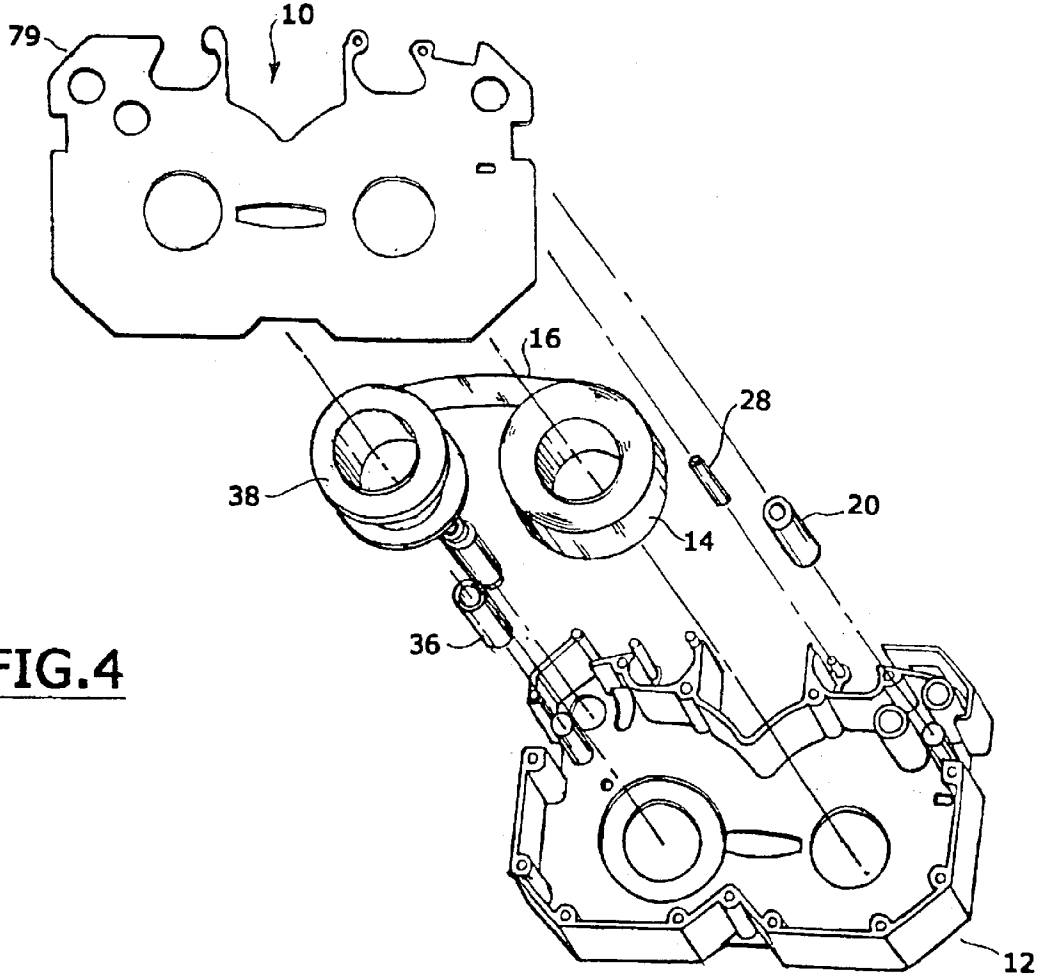
FIG. 4 is an exploded view of the ribbon cassette of FIG. 1.
Figure 5B:
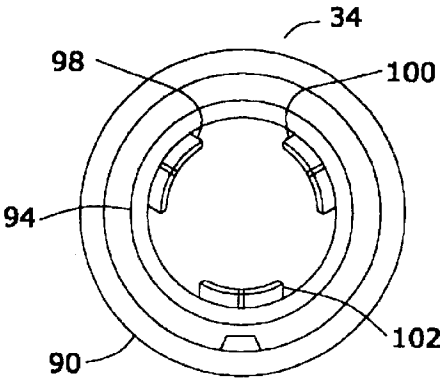
FIGS. 5A, 5B, and 5C are a sectional view, an end view, and a front view of the drive roller used in the ribbon cassette of FIG. 1.
Figure 5A:
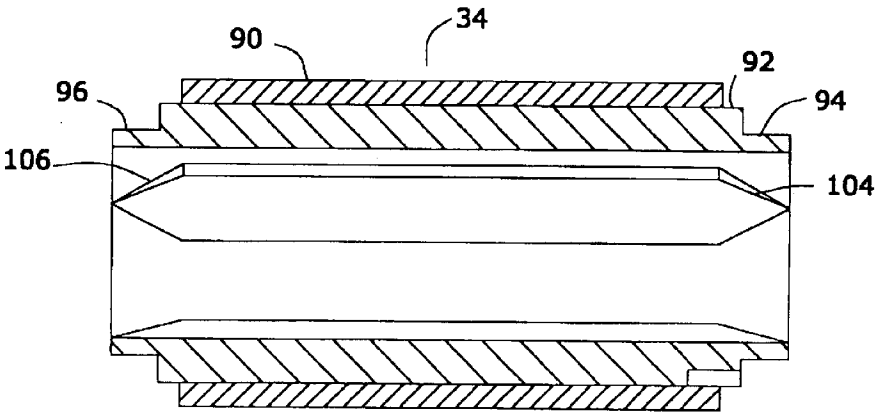
Figure 5C:
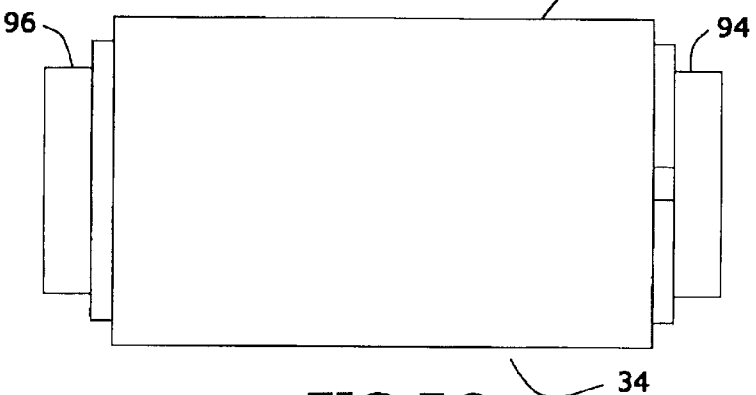

FIG. 4 is an exploded view of ink ribbon cassette 10 illustrating how cartridge cover 79 is preferably connected to casing 12 and, when so connected, encloses ribbon 16 with its supply core 14 and its take up core 38 FIG. 5A is a sectional view of drive roller 34. In the preferred embodiment depicted therein, it will be seen that drive roller 34 is comprised of elastomeric surface 90 bonded to cylindrical wall 92. The cylindrical wall 92 preferably is made out of a plastic material, such as polystyrene. In one embodiment, the cylindrical wall 92 has a Shore hardness of at least about 60.

In the embodiment depicted in FIG. 5A, the drive roller 34 preferably is comprised of reduced diameter sections 94 and 96 to facilitate the location of the drive roller 34 within the casing 12.

A multiplicity of drive splines 98, 100, and 102 are disposed on the inside surface of cylindrical wall 92 to engage the a typical printer drive shaft (not shown). In the preferred embodiment depicted in FIGS. 5A and 5B, each of splines 98, 100, and 102 preferably contains angled ends 104 and 106 to facilitate the engagement of such splines with the printer drive shaft (not shown).

FIG. 6A is a partial sectional view of one preferred embodiment of guide roller 28. FIGS. 6B, 6C, and 6D are sectional, top, and bottom views of such guide roller 28.

It is preferred that the guide roller 28 be made out of a material with a Shore hardness of at least about 60 such, as, e.g., hard polystyrene.

Figure 22A:
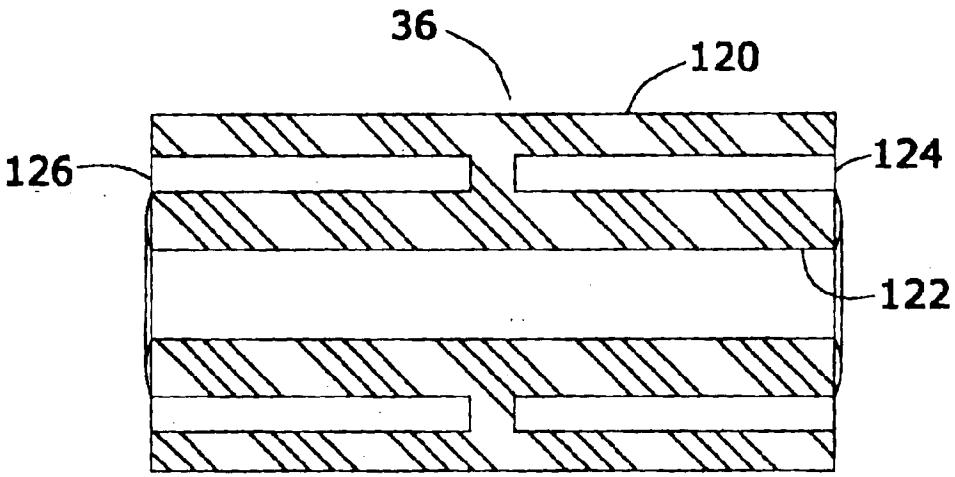
FIGS. 22A and 22B are sectional and top views of the nip roller used in the ribbon cassette of FIG. 1.

FIG. 22A is a sectional view of nip roller 36 (see FIG. 1). In one embodiment, the nip roller 36 may also be used as guide roller 20.

Referring to FIG. 22A, and in the preferred embodiment depicted therein, it will be seen that nip roller 36 is comprised of an outer annular wall and an inner annular wall 122. In one embodiment, not shown, there are no orifices or no spaces between the outer annular wall 120 and the inner annular wall 122. In the embodiment depicted in FIG. 22A, cutout portions 124 and 126 have been removed from the roller 36.

In the preferred embodiment depicted, nip roller 36 is comprised of outer wall 120 that is relatively hard, with a Shore hardness of at least 60. With this embodiment, it is preferred that the drive roller 34 have an elastomeric outer surface 90 that is compressible and preferably has a hardness of less than 60. It is preferred that the Shore hardness of outer wall 120 be at least 30 Shore hardness units greater than the Shore hardness of elastomeric outer surface 90.

Figure 22B:
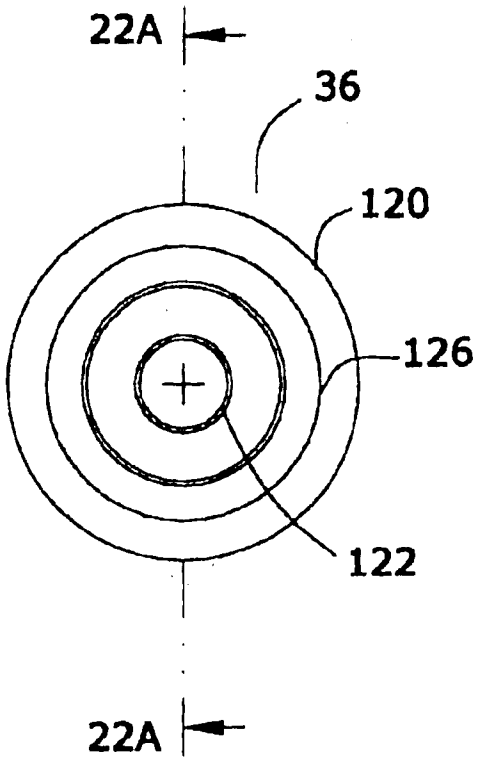

FIG. 22B is an end view of the preferred nip roller 36.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An ink ribbon cassette comprising a supply core, a web disposed on said supply core, a storage core, means for passing said web from said supply core to said storage core, means for increasing the tension on said web as it passes from said supply core to said storage core to produce a tensioned web, a drive roller contiguous with said tensioned web, and a nip roller contiguous with said tensioned web, wherein:

(a) said tensioned web is passed in a first rotary direction around a portion of said drive roller, and said tensioned web is passed in a direction around a portion of said nip roller, wherein said first rotary direction is opposite to said second rotary direction; and (b) said tensioned web is passed in said first rotary direction around a portion of said storage core, wherein said drive roller, said tensioned web, and said nip roller form a nip that compresses the diameter of at least one of said drive roller and nip roller by at least about 0.001 percent, wherein said means for increasing the tension on said web as it passes from said supply core to said storage core is comprised of a first stationary brake, wherein said means for increasing the tension on said web as it passes from said supply core to said storage core is comprised of a second stationary brake, wherein said means for increasing the tension on said web as it passes from said supply core to said storage core is comprised of a guide roller, wherein each of said first stationary brake and said second stationary brake has a cylindrical shape, wherein each of said first stationary brake and said second stationary brake has a diameter of at least about 0.25 inches, wherein each of said first stationary brake and said second stationary brake have a coefficient of friction when in contact with said web of from about 0.2 to about 0.6, wherein the angle of wrap of said web around said first stationary brake and said second stationary brake is from about 180 to about 360 degrees.

2. An ink ribbon cassette comprising a supply core, a web disposed on said supply core, a storage core, means for passing said web from said supply core to said storage core, means for increasing the tension on said web as it passes from said supply core to said storage core to produce a tensioned web, a drive roller contiguous with said tensioned web, and a nip roller contiguous with said tensioned web, wherein:

(a) said tensioned web is passed in a first rotary direction around a portion of said drive roller, and said tensioned web is passed in a direction around a portion of said nip roller, wherein said first rotary direction is opposite to said second rotary direction; and (b) said tensioned web is passed in said first rotary direction around a portion of said storage core, wherein said drive roller, said tensioned web, and said nip roller form a nip that compresses the diameter of at least one of said drive roller and nip roller by at least about 0.001 percent, wherein said drive roller is comprised of elastomeric material, wherein said elastomeric material has a Shore hardness of from about 30 to about 60, wherein said nip roller is comprised of plastic material with a Shore hardness of at least about 60 and at least about 30 Shore hardness units greater than the Shore hardness of said elastomeric material.

* * * * *